US005497703A

United States Patent [19]

Becker

[11] Patent Number: 5,497,703

[45] Date of Patent: Mar. 12, 1996

[54] DEVICE FOR ADJUSTING THE OBLIQUE REGISTER IN A CLAMPING DEVICE FOR LOCKING PRINTING PLATES IN AN OFFSET PRINTING MACHINE

[75] Inventor: Willi Becker, Bammental, Germany

[73] Assignee: Heidelberger Druckmaschinen AG, Heidelberg, Germany

[21] Appl. No.: 203,279

[22] Filed: Feb. 28, 1994

[30] Foreign Application Priority Data

Feb. 27, 1993 [DE] Germany ..... 43 06 237.7

[51] Int. Cl.[6] ..... B41F 21/00

[52] U.S. Cl. ..... 101/415.1; 101/DIG. 36

[58] Field of Search ..... 101/378, 382.1, 101/383, 415.1, DIG. 36; 33/614–621

[56] References Cited

U.S. PATENT DOCUMENTS

| | | | |
|---|---|---|---|
| 3,218,970 | 11/1965 | Heimlicher et al. | 101/378 |
| 3,835,778 | 9/1974 | Bock | 101/415.1 |
| 4,437,407 | 3/1984 | Wirz et al. | 101/409 |
| 4,557,196 | 12/1985 | Köbler | 101/415.1 |
| 4,759,287 | 7/1988 | Shizuya | 101/415.1 X |
| 5,012,738 | 5/1991 | Bloothoofd | 101/415.1 |
| 5,026,045 | 6/1991 | Wirz et al. | 101/415.1 X |
| 5,259,312 | 11/1993 | Simeth et al. | 101/415.1 |
| 5,299,498 | 4/1994 | Spiegel et al. | 101/415.1 X |
| 5,370,051 | 12/1994 | Schild et al. | 101/415.1 |

FOREIGN PATENT DOCUMENTS

| | | | |
|---|---|---|---|
| 0142728 | 5/1985 | European Pat. Off. | 101/DIG. 36 |
| 1223400 | 8/1966 | Germany . | |
| 3138865 | 12/1983 | Germany . | |
| 3222022 | 12/1985 | Germany . | |
| 9116491 | 12/1992 | Germany . | |
| 9215069.1 | 2/1993 | Germany . | |
| 4210897 | 8/1993 | Germany . | |
| 9308657 | 9/1993 | Germany . | |
| 0452954 | 5/1975 | U.S.S.R. | 101/415.1 |
| 2167712 | 6/1986 | United Kingdom | 101/415.1 |
| 2193685 | 2/1988 | United Kingdom | 101/415.1 |

*Primary Examiner*—Christopher A. Bennett
*Attorney, Agent, or Firm*—Herbert L. Lerner; Laurence A. Greenberg

[57] ABSTRACT

A device for adjusting the oblique register in a clamping device for locking printing plates in an offset printing machine. A clamping bar which opens and closes a gap is oriented for insertion of the front or rear edge of a printing plate at the jacket face of the plate cylinder parallel to the cylinder axis. A centering bolt is secured to the clamping bar and it is oriented radially to the plate cylinder and it extends into the insertion gap. The centering belt has a profile which corresponds to the printing plate. The centering bolt is secured on the one outer region of the clamping device so that a stop being oriented in the circumferential direction of the plate cylinder is adjustably attached on the outer regions o the clamping device in the insertion gap. The position of the stop is adjusted with a device disposed on the plate clamping device.

12 Claims, 2 Drawing Sheets

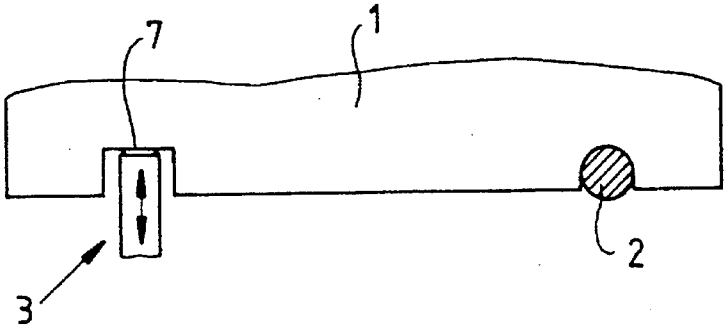
Fig.1
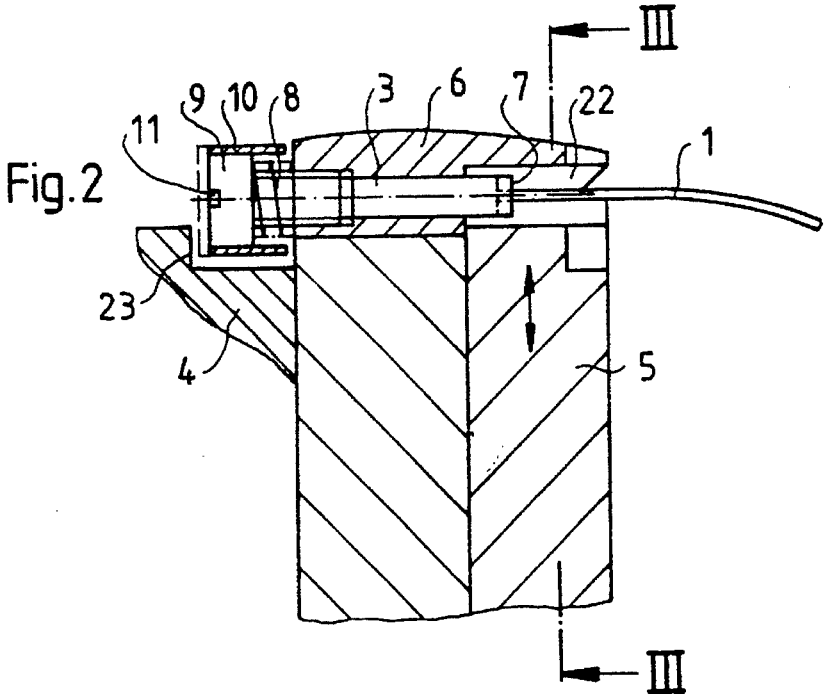
Fig.2
Fig.3
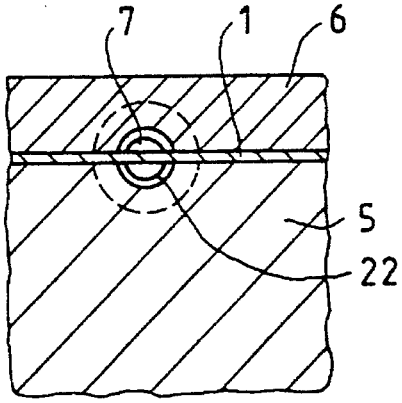
Fig.2a
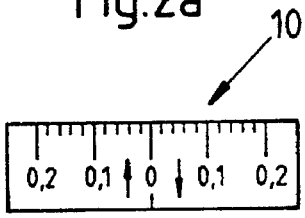

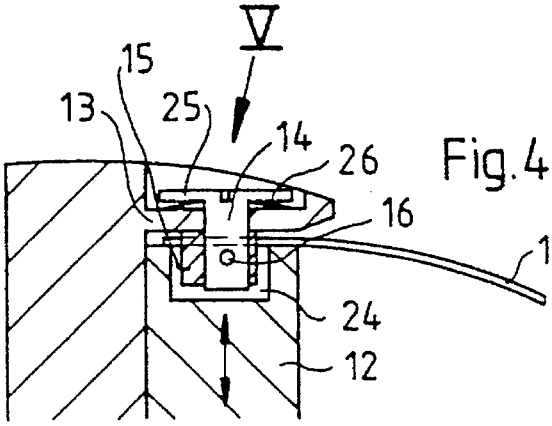
Fig.4
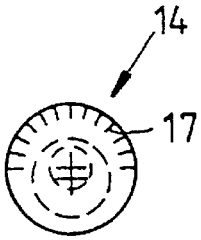
Fig.5
Fig.6
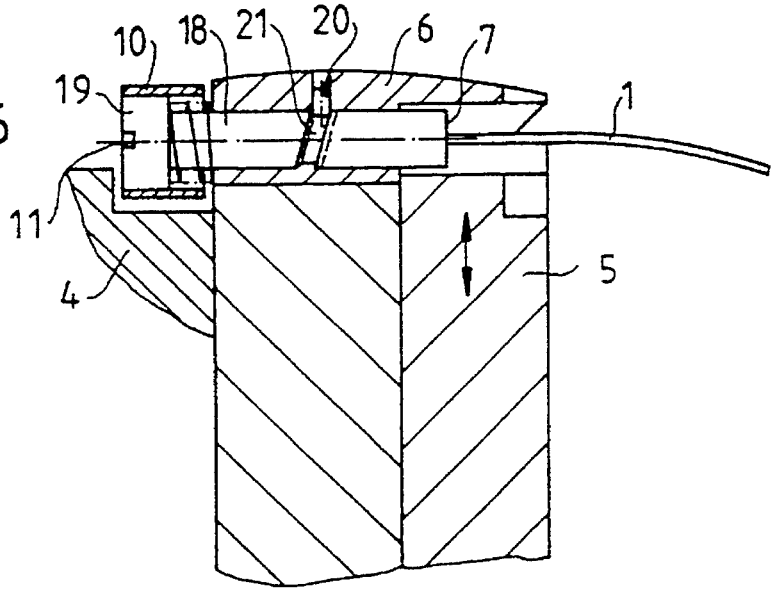

DEVICE FOR ADJUSTING THE OBLIQUE REGISTER IN A CLAMPING DEVICE FOR LOCKING PRINTING PLATES IN AN OFFSET PRINTING MACHINE

BACKGROUND OF THE INVENTION

FIELD OF THE INVENTION

The invention relates to a device for adjusting the oblique register in a clamping device for locking printing plates in an offset printing machine, in which a clamping bar with means for opening and closing a gap is oriented for insertion of the front or rear edge of a printing plate at the jacket face of the plate cylinder parallel to the cylinder axis, and in which a centering bolt oriented radially to the plate cylinder and extending into the insertion gap is secured, the centering bolt having a profile which corresponds to the profile of a centering groove in the insertion edge of the printing plate.

It is known for printing plates to be clamped in the plate cylinder of an offset printing machine in clamping bars. To obtain a precisely defined position of the printed image on the printed sheet of paper, the printing image located on the printing plate must also be in a very precisely defined position. Various inaccuracies, however, for instance in the area of the make-up of the image on the plate, due to stamping errors in the printing plate or other errors in the preliminary printing stage, including possibly incorrect locking of the printing plate, can lead to repeated occurrences of slight deviations of the printing image on the printing plate from the defined position thereof on the plate cylinder. Particularly in multicolor printing, the printing images mounted on the printing plates must be matched accurately relative to one another. To compensate for these deviations of the printing image from the defined position, it is known to provide correction devices for correcting the position of the printing plate in the plate cylinder. Corrections may become necessary in order to adjust the printing image laterally, circumferentially, and obliquely.

For oblique adjustment, it is known to employ complicated, expensive provisions for final oblique adjustment, relative to the plate cylinder, of the clamping bars for locking the printing plate, after the printing plate has been locked.

The object of the invention is to enable genuine oblique adjustment of the printing plate, simply and economically.

According to the invention, this is attained by the embodiment of a clamping device for locking printing plates in an offset printing machine in accordance with the characteristics of claim 1. The stop, adjustable in the circumferential direction, in the clamping bar enables simple oblique adjustment of the printing plate. The printing plate is centered on one side with a prestamped centering groove in the fixed centering bolt and can be rotated about the centering bolt and thus obliquely adjusted by simple adjustment of the stop, which acts in the clamping bar on the other side of the printing plate. In the case of manual actuation, the clamping bar is first opened, then the stop is adjusted in accordance with the deviation value, which is ascertained in a conventional manner, and once the plate is in place again the clamping bar is closed again. An adjustment even before locking is also possible, if the deviation is ascertained beforehand in a conventional manner from the printing image on the printing plate. Automatic opening, remeasurement, readjustment and closure is also possible in a simple way. The oblique adjustment enables correct adjustment of the position with little effort or expense.

The embodiment according to the invention as defined by the characteristic of claim 2 is especially simple and economical. Additional adjusting means can be dispensed with. A stop as defined by the characteristics of claim 3 is especially easy to use and to make. By simply rotating the stop about its axis of symmetry, reliable oblique adjustment is possible. An embodiment according to the invention as defined by the characteristics of claims 4 and 5 additionally promotes secure, reliable control of the oblique adjustment without major effort or expense. The embodiment as defined by the characteristics of claims 6 and 7 represent especially preferred embodiments. An especially simple economical clamping device is made possible by the embodiments defined by the characteristics of claims 8–10.

The embodiment of the invention in accordance with the characteristics of claim 11 additionally enables easy control with the aid of a tool. This tool can be coupled permanently or releasably with the stop under automatic control.

The embodiment according to the invention as defined by the characteristic of claim 12 additionally promotes the accurate adjustment of the stop and hence the accurate oblique adjustment of the plate.

The embodiment according to the invention as defined by the characteristic of claims 13 and 14 furnishes especially simple, reliable clamping devices for the oblique adjustment.

The invention will be described in detail below in terms of the embodiments shown in FIGS. 1–6.

BRIEF DESCRIPTION OF THE DRAWINGS

FIG. 1, a schematic plan view on a printing plate centered in the clamping bar;

FIG. 2, an exemplary embodiment with an adjusting screw, in a sectional side view of the clamping device;

FIG. 2*a*, a developed view of the scale provided on the head of the screw;

FIG. 3, the adjusting device in a section taken along the line III—III of FIG. 2;

FIG. 4, a further exemplary embodiment of the adjusting device;

FIG. 5, a plan view of the adjusting device of FIG. 4;

FIG. 6, a further exemplary embodiment of the invention.

DESCRIPTION OF THE PREFERRED EMBODIMENT

FIGS. 1 to 3 show an exemplary embodiment according to the invention, in which the front end of a printing plate 1 is fastened in a gap of a clamping bar defined between a fixed clamping bar part 6 and a clamping bar part 5, which is adjustable as indicated by the arrow in FIG. 2 for locking and disconnection purposes, of a plate cylinder 4 in an offset printing machine of a known type. The plate 1 is rotatably fixed at a first outer marginal region of the printing plate with a semicircular stamped-out centering groove on a fixing bolt 2 secured radially to the plate cylinder between the fixed clamping bar part 6 and the displaceable clamping bar part 5. On the other side, i.e. at a second outer marginal region, the printing plate is placed with a lay edge of a prestamped lay groove against the stop face 7 of a stop screw 3. The stop screw 3 is screwed into a through bore in the fixed clamping bar part 6 in such a way that with its stop face 7 provided on the end of the screw, it engages a cylindrical recess 22 between the fixed clamping bar part 6 and the adjustable clamping bar part 5. On the other side of the fixed clamping bar part 6, counter to the direction of plate insertion, a cylindrical scale 10 is secured to the circumference of the head 9 of the screw 3. A prestressing spring 8 is operative between the screw head 9 and the fixed clamping bar part 6. The screw head 9 is equipped with an internal profile 11 for engagement by a tool. For unlocking the plate, the displaceable clamping bar part 5 is adjusted downwardly as shown in FIG. 2, so that the gap between the fixed and the adjustable clamping bar parts 5, 6 becomes larger, and the printing plate 1 can be withdrawn. Before a plate is fastened, the position of the printing image on the printing plate is measured in a known manner, and the deviation from the desired command position is thus ascertained.

Depending upon the deviation in the oblique position, the stop screw 3 is adjusted with the aid of the fine scale 10 in such a way that the deviation in the oblique position can be eliminated. It is conceivable for this purpose to provide a counterpart marking on the fixed clamping part, for instance, for the sake of better adjustability. After adjustment of the position of the stop screw 3, the plate 1 is inserted into the gap between the fixed and the displaceable clamping parts 5, 6, so that the printing plate 1 is centered on the fixed centering bolt 2 and on its other side rests on the stop face 7 of the stop screw 3. Then, the adjustable clamping part 5 is displaced upwardly in terms of the view of FIG. 2, until the printing plate 1 is fastened. To limit the adjustment path of the stop screw 3, a stop face 23 is provided in the plate cylinder 4. The prestressing of the spring 8 prevents unintentional loosening of the stop screw 3. The stop screw 3 is provided with a low thread pitch, to provide a capability of sensitive adjustment.

FIGS. 4 and 5 show a further exemplary embodiment of the invention. A pintle or pivot pin 14 is passed through a through bore in the fixed clamping part 13, perpendicularly to the direction of insertion of the printing plate 1. In the region of the lower clamping part, there is a recess 24 into which the pintle 14 extends by its lower end. A cylinder bolt 15 is eccentrically secured to the lower end of the pintle 14 with the aid of a pin 16. A cup spring 26, which presses the pintle 14 upwardly far enough so that the cylinder bolt 15 enters into physical contact, at its upper surface with the fixed clamping bar part 13, acts between the head 25 of the pintle 14 and the fixed clamping bar part 13. The tension is selected so that the pintle 14 can be adjusted in self-locking fashion. For locking, the printing plate 1 is inserted into the opened gap between the fixed and the displaceable clamping bars 13, 12 in such a way that it rests with its prestamped centering groove against the centering bolt 2 as shown in FIG. 1 and with its other prestamped groove against the circumferential face of the cylinder bolt 15. By rotating the pintle 14, the eccentric cylinder bolt is rotated about the axis of the pintle 14 in such a way that a stop face of the cylinder bolt 15 for the printing plate 1 changes its position in the insertion direction. Thus, an accurate oblique adjustment can be performed. For better oblique adjustment, a scale 17 is applied to the head of the pintle 14.

FIG. 6 shows a further exemplary embodiment of the invention, in which instead of the stop screw 3 of the exemplary embodiment of FIGS. 1 to 3, a cylinder bolt 18 is movably supported, with a circumferential groove 21 formed as an axial cam, in a through bore of the fixed clamping bar part 6. A guide pin 20 which engages the axial cam groove 21 is secured in the fixed clamping bar part 6 and acts as a deflection element. By rotating the head 19, the stop face 7 of the cylinder bolt 18, because of the deflection in the movement, can be displaced axially by the guide pin 20 and the axial cam groove 21. The inclination of the axial cam groove which is chosen is small.

FIG. 2 shows the stop screw 3 in an adjusted position represented by broken lines.

It is conceivable for not only the clamping bar 5 but also the stop screw 3, the stop pin 18 or the pintle 14 to be adjusted automatically. For instance, it is conceivable to adjust the pintle 14 automatically from below, through the adjustable clamping bar 12.

I claim:

1. In an offset printing press with a plate cylinder having a jacket surface and a cylinder axis, and a clamping device for locking printing plates in the plate cylinder of the offset printing press, a device for adjusting oblique register of the printing plates, comprising:

a stationary clamping bar oriented parallel to the axis of the plate cylinder on the jacket surface of the plate cylinder and fixed in a circumferentially stationary position relative to the plate cylinder, said clamping bar having a first outer marginal region and a second outer marginal region, and said clamping bar having first and second clamping bar parts defining a gap therebetween for receiving and clamping therein a leading or trailing edge of a printing plate inserted in a given direction of insertion and means for opening and closing the gap;

a centering bolt secured in said first outer marginal region of said clamping bar and having a longitudinal axis oriented radially to the plate cylinder and extending into said gap, said centering bolt having a profile corresponding to a profile of a centering groove formed in the edge of the printing plate to be received in said gap;

and adjustable stop means including a stop having a longitudinal axis oriented in circumferential direction of the plate cylinder in said second outer marginal region of said clamping bar, said stop being mounted on said clamping bar and extending into said gap so as to be movably adjustable in the circumferential direction of the plate cylinder for correcting plate obliqueness; and means for adjusting the position of said stop.

2. The adjusting device according to claim 1, wherein said adjusting means form part of said stop.

3. The adjusting device according to claim 1, wherein said stop has an axially symmetrical construction and is mounted so as to be rotatable about an axis of symmetry thereof;

corresponding deflection elements being provided on said stop and on said clamping bar for converting the rotational motion of said stop into translational motion in the given direction of insertion.

4. The adjusting device according to claim 1, including another stop for limiting a path of adjustment of said first-mentioned stop.

5. The adjusting device according to claim 3, wherein said stop includes a circumferential jacket surface, and said stop is formed with regions on the circumferential jacket surface thereof for introducing force for effecting rotational adjustment.

6. The adjusting device according to claim 2, wherein said adjusting means include a screw having a thread corresponding to a thread formed in the clamping device, and said stop is an end of the screw.

7. The adjusting device according to claim 2, wherein said stop is formed as a stop pin;

one of said stop and the clamping device having an axial cam and the other of said stop and the clamping device having a cam follower element corresponding to said axial cam.

8. The adjusting device according to claim 2, wherein said stop has an adjustable eccentric region rotatably mounted in an insertion plane perpendicularly to the given direction of insertion.

9. The adjusting device according to claim 2, wherein said stop is formed with a profile for cooperative engagement by a tool.

10. The adjusting device according to claim 2, wherein said stop has means for determining an axial position of said stop.

11. The adjusting device according to claim 3, wherein said axis of symmetry of said stop is oriented in said direction in which the printing plate is insertable into the gap.

12. The adjusting device according to claim 2, wherein the axis of symmetry of the stop is perpendicular to the insertion direction of the printing plate.

* * * * *